US010016009B1

(12) United States Patent
Bacchus

(10) Patent No.: US 10,016,009 B1
(45) Date of Patent: Jul. 10, 2018

(54) HARD HAT SAFETY LINE SYSTEMS

(71) Applicant: Colin Bacchus, Brooklyn, NY (US)

(72) Inventor: Colin Bacchus, Brooklyn, NY (US)

( * ) Notice: Subject to any disclaimer, the term of this patent is extended or adjusted under 35 U.S.C. 154(b) by 848 days.

(21) Appl. No.: 14/318,759

(22) Filed: Jun. 30, 2014

Related U.S. Application Data

(60) Provisional application No. 61/874,812, filed on Sep. 6, 2013.

(51) Int. Cl.
*A42B 7/00* (2006.01)
*A42B 3/04* (2006.01)

(52) U.S. Cl.
CPC ..... *A42B 7/00* (2013.01); *A42B 3/0406* (2013.01)

(58) Field of Classification Search
CPC .... A42B 3/08; A42B 3/04; A42B 3/20; A42B 3/0473; A42B 3/063; A42B 3/145; A42B 3/221; A42B 3/06; A42B 3/064; A42B 3/12; A42B 3/125; A42B 3/0406; A42B 3/085; A42B 3/121; A42B 3/14; A42B 3/22; A42B 1/08; A42B 7/00; A42B 1/10
USPC ..... 2/421, 422, 423, 209.13; 224/162, 604; 455/186.1
See application file for complete search history.

(56) References Cited

U.S. PATENT DOCUMENTS

| | | | |
|---|---|---|---|
| 4,559,586 | A | 12/1985 | Slarve |
| 8,046,846 | B2 | 11/2011 | Karlsson et al. |
| 2004/0055077 | A1 | 3/2004 | Wright |

*Primary Examiner* — Alissa L Hoey
*Assistant Examiner* — Catherine M Ferreira
(74) *Attorney, Agent, or Firm* — RG Patent Consulting, LLC; Rachel Gilboy

(57) ABSTRACT

A safety line assembly is a lightweight retractable cord on a reel having a first and a second biasing spring-clip for attaching a hard hat to a user's safety harness when working above the ground to prevent the hard had from accidently striking an individual or object below the user if the hard hat unintentionally falls off of the head of the user. The first biasing spring clip is attached to the reel housing via the first cord. The second cord attaches to the retractable reel within the housing for the reel and extends exteriorly of the housing to attach to the second biasing spring-clip. The retractable reel keeps the second cord wound onto the reel only releasing enough slack to allow free movement of the user's head eliminating additional slack to prevent entanglement of the cord.

16 Claims, 5 Drawing Sheets

HARD HAT SAFETY LINE SYSTEMS

CROSS-REFERENCE TO RELATED APPLICATION

The present application is related to and claims priority from prior provisional application Ser. No. 61/874,812, filed Sep. 6, 2013 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of construction safety devices and more specifically relates to a hard hat safety line system.

2. Description of the Related Art

Hard hats are a required piece of personal protective equipment by the Occupational Safety and Health Administration (OSHA) for employees of companies that work in certain industries such as mining, construction, and utilities, just to name a few. Head injuries by employees of these trades dramatically decreased following the implementation and use of the code of federal regulations regarding head protection (CFR 1926.100) for employees of companies where the impact of falling objects, impact from flying objects, or electrical shock is a possibility. OSHA investigates all domestic workplace fatalities and companies are required to record and report incidents involving injuries resulting in lost work time. The statistics are recorded and categorized so a relatively accurate record of the amount of head injuries that occur from year to year are available for individuals to see.

While many accidents have been prevented by the use of hard hats, hard hats have also been the cause of a percentage of head injuries. These statistics do not fit so neatly into the standard categories of injuries, so they may end up in a miscellaneous category. Just one example of a workplace environment that has a possibility of falling hard hats being responsible for avoidable accidents is in the ironworker trades. Generally, ironworkers work high off of the ground on narrow steel beams while attaching the ends and it is easy for a hard hat to get bumped and knocked off of the head of the wearer. Regardless of the weight of the hard hat, it is generally just heavy enough to cause a fatality if it falls from the common working heights and strikes another worker below. Workers still must wear hard hats because there are heavy fines and large penalties for being caught without them. The penalties by the companies themselves to their employees can disciplinary action up to and including termination for being caught without a hard hat in a hard hat area. In most modern jurisdictions, everyone on site during construction must employ the use of properly-rated head protection gear at all times. There are very large penalties, in the form of both municipal fines for bylaw infraction and also federal fines for occupational health and safety practice violations, designed specifically to ensure that everyone in the construction industry is deadly serious about the potentially lethal effects of not wearing a hard hat. Because government imposed fines to companies are so 'stiff', employers tend to make examples of anyone not using proper personal protective equipment. An employee reporting a lost hard hat while on the job is hard enough to explain, but an injury or fatality involving a dropped hard hat is entirely another. A device that eliminates accidents of this type, and is convenient enough that workers will use it, is needed.

Various attempts have been made to solve the above-mentioned problems such as those found in U.S. Pat. No. 4,559,586 to Michael Slarve, U.S. Pat. No. 8,046,846 to Jimmie Karlsson et al, and U.S. Pub. No. 2004/0055077 to Jay Michael Wright. This art is representative of helmet restraint devices. None of the above inventions and patents, taken either singly or in combination, is seen to describe the invention as claimed.

Ideally, a helmet restraint device should provide added hard hat drop prevention safety and convenience of use, and yet, would operate reliably and be manufactured at a modest expense. Thus, a need exists for a reliable hard hat safety line system to avoid the above-mentioned problems.

BRIEF SUMMARY OF THE INVENTION

In view of the foregoing disadvantages inherent in the known helmet restraint device art, the present invention provides a novel hard hat safety line system. The general purpose of the present invention, which will be described subsequently in greater detail, is to provide added hard hat drop prevention safety and convenience of use.

The present invention, hard hat safety line system as disclosed herein preferably comprises a safety line assembly having a first biasing spring-clip, a second biasing spring-clip, a first cord having a first end and a second end, a second cord having a proximate and a distal end, a housing having a spool, an inner volume, an attachment ring, and a cord orifice.

The safety line assembly comprising the first biasing spring-clip, the second biasing spring-clip, the first cord, the second cord, the spool, and the housing are operatively structured and arranged to provide a retractable cord for attaching the first biasing spring-clip to a user and the second biasing spring-clip to a hard hat to prevent the hard hat from unintentionally falling off of a head of the user to a point of impact below the user. The safety line assembly provides a tether between the hard hat and the safety harness while eliminating a cord entanglement hazard. The housing of the safety line assembly is able to be removably attached to a user's safety harness via the first biasing spring-clip and the first cord, and the second biasing spring-clip of the second cord attached to the hard hat. The first biasing spring-clip is attached to the first end of the first cord. The first biasing spring-clip may comprise a carabiner and be made of aluminum such that it is lightweight.

The first cord is about 6 inches long or less so that the housing can be located in close proximity to the first biasing spring-clip. The second end of the first cord is attached to the attachment ring and the attachment ring is removably attached to the attachment ring end of the housing. The spool is rotationally attached to and located within the inner volume of the housing. The housing preferably comprises a circular disc shape and may be about 1½ inches in diameter and about ½ inch thick to reduce weight and bulk such that the safety line assembly is convenient to wear. The housing further may comprise a clip mounted on the housing such that the housing is able to be directly connected to the hard hat or clipped to other objects. The housing may comprise hardened plastic in some embodiments such that the housing is lightweight.

The spool may comprise a flat spiral spring that is structured and arranged to tensionally-wind the spool to retract the second cord onto the spool when the flat spiral spring is returning to an un-tensioned state. The flat spiral spring preferably comprises a low tension spring force sufficient for reeling the second cord onto the spool. The distal end of the second cord is attached to the spool such that the second cord is able to wrap circumferentially about the spool, the proximate end passing from the inner volume through the cord orifice on the second end of the housing, to removably attached the proximate end of the second cord to the second biasing clip exteriorly of the housing. The proximate end of the second cord comprises a loop; the loop preferably formed by the proximate end being doubled back and secured by a crimp-lug.

The second biasing spring-clip may also be a carabiner and comprise aluminum such that it is lightweight. The second cord preferably comprises a high tensile strength fiber and is about 24 inches long such that the length of the second cord is sufficient to be attached to various attachment points of varying distances on a harness while the user wears the hard hat without the cord pulling the hard hat. The safety line assembly is useful for attaching the first biasing spring-clip to the hard hat and the second biasing spring-clip to the user to prevent the user from unintentionally dropping the hard hat and inadvertently striking a person located below the user, thereby increasing a relative safety of the person(s) located below the user.

The hard hat safety line system may comprise a kit including at least one fully assembled safety line assembly for attaching to a hard hat and to a safety harness to prevent unintentional dropping of the hard hat, and a set of user-instructions.

A method of using the hard hat safety line system may comprise the steps of attaching the first biasing spring-clip of the safety line assembly to a user-worn safety harness, attaching the second biasing spring-clip of the safety line assembly to a hard hat, wearing the hard hat and the safety harness having the safety line assembly attached thereto, disconnecting the second biasing spring-clip from the hard hat, disconnecting the first biasing spring-clip from the safety harness, and storing the safety line assembly. Other connection means between the hardhat and the user may be employed.

The present invention holds significant improvements and serves as a hard hat safety line system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, hard hat safety line system, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a helmet restraint device and more particularly to a hard hat safety line system as used to improve the safety and convenience of use.

Generally speaking, a safety line assembly is a lightweight retractable cord on a reel having a first and a second biasing spring-clip for attaching a hard hat to a user's safety harness when working above the ground to prevent the hard had from accidently striking an individual or object below the user if the hard hat unintentionally falls off of the head of the user. The first biasing spring clip is attached to the reel housing via the first cord. The second cord attaches to the retractable reel within the housing for the reel and extends exteriorly of the housing to attach to the second biasing spring-clip. The retractable reel keeps the second cord wound onto the reel only releasing enough slack to allow free movement of the user's head eliminating additional slack to prevent entanglement of the cord.

Figure 1:
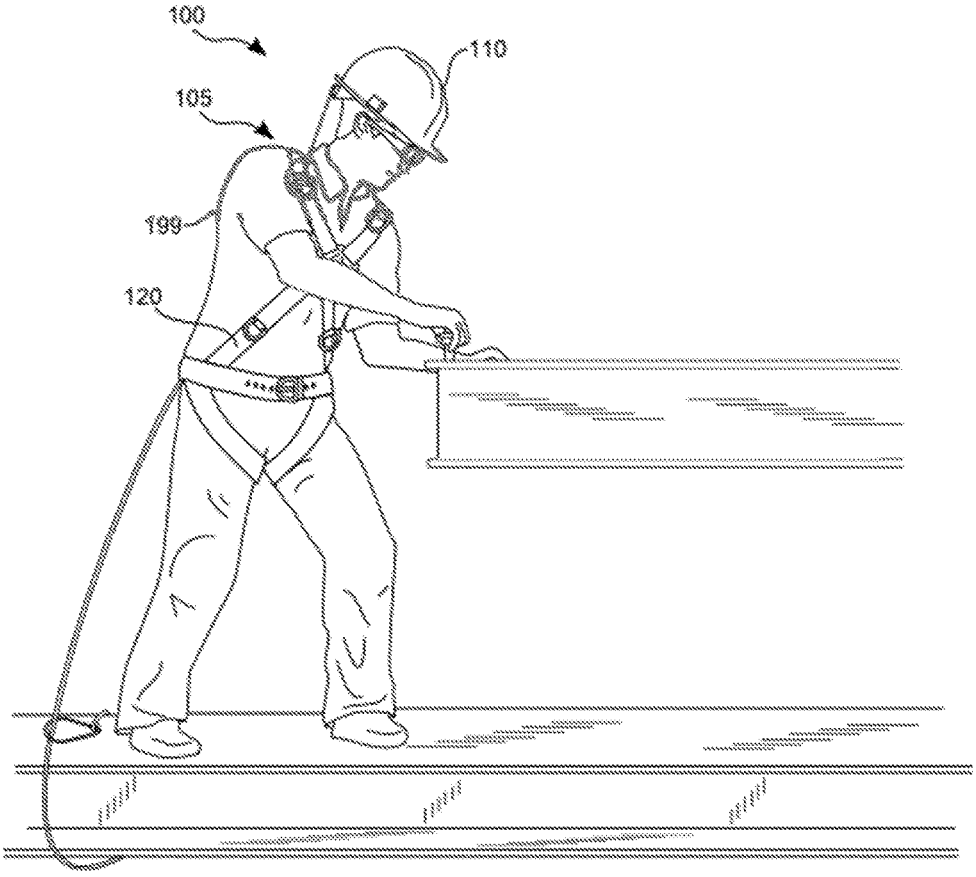
FIG. 1 shows a perspective view illustrating an in-use condition of a hard hat safety line system according to an embodiment of the present invention.

Referring to the drawings by numerals of reference there is shown in FIG. 1, a perspective view illustrating hard hat safety line system 100 according to an embodiment of the present invention of FIG. 1.

Safety line assembly 105 provides a tether between hard hat 110 and safety harness 120 while eliminating a cord entanglement hazard for user 199. Spool 130 reels up any slack of second cord 150 into housing 170 but doesn't pull on hard hat 110 of user 199 enough to cause discomfort. Second biasing spring-clip 190 is preferably attached to hard hat 110 and may be smaller than first biasing spring-clip 180.

In some embodiments, second biasing spring-clip 190 may attached to a plastic rectangular piece that has a snap-lock edge for locking into the ear piece receiver that most hard hats 110 are manufactured with. The plastic piece may come as an accessory but second biasing spring-clip 190 may be used to directly attach to the back of hard hat 110. Housing 170 of safety line assembly 105 is preferably able to be removably attached to user's 199 safety harness 120 via first biasing spring-clip 180 and first cord 140. Second biasing spring-clip 190 of second cord 150 is preferably attached to hard hat 110 so housing 170 with spool 130 can be carried attached to the body.

First biasing spring-clip 180 is attached to first end 142 of first cord 140 and may preferably comprise a carabiner and be made of aluminum such that it is lightweight but strong, but first biasing spring-clip 180 may also be other types of spring clips in the biasing gate hook family depending on embodiment. Safety line assembly 105 may be used for many other suitable purposes as well, but is particularly useful for attaching second biasing spring-clip 190 to hard hat 110 and first biasing spring-clip 180 to user 199 to prevent user 199 from unintentionally dropping hard hat 110 and inadvertently striking a person located below user 199, which thereby increases the safety for those person(s) located below user 199.

Figure 2:
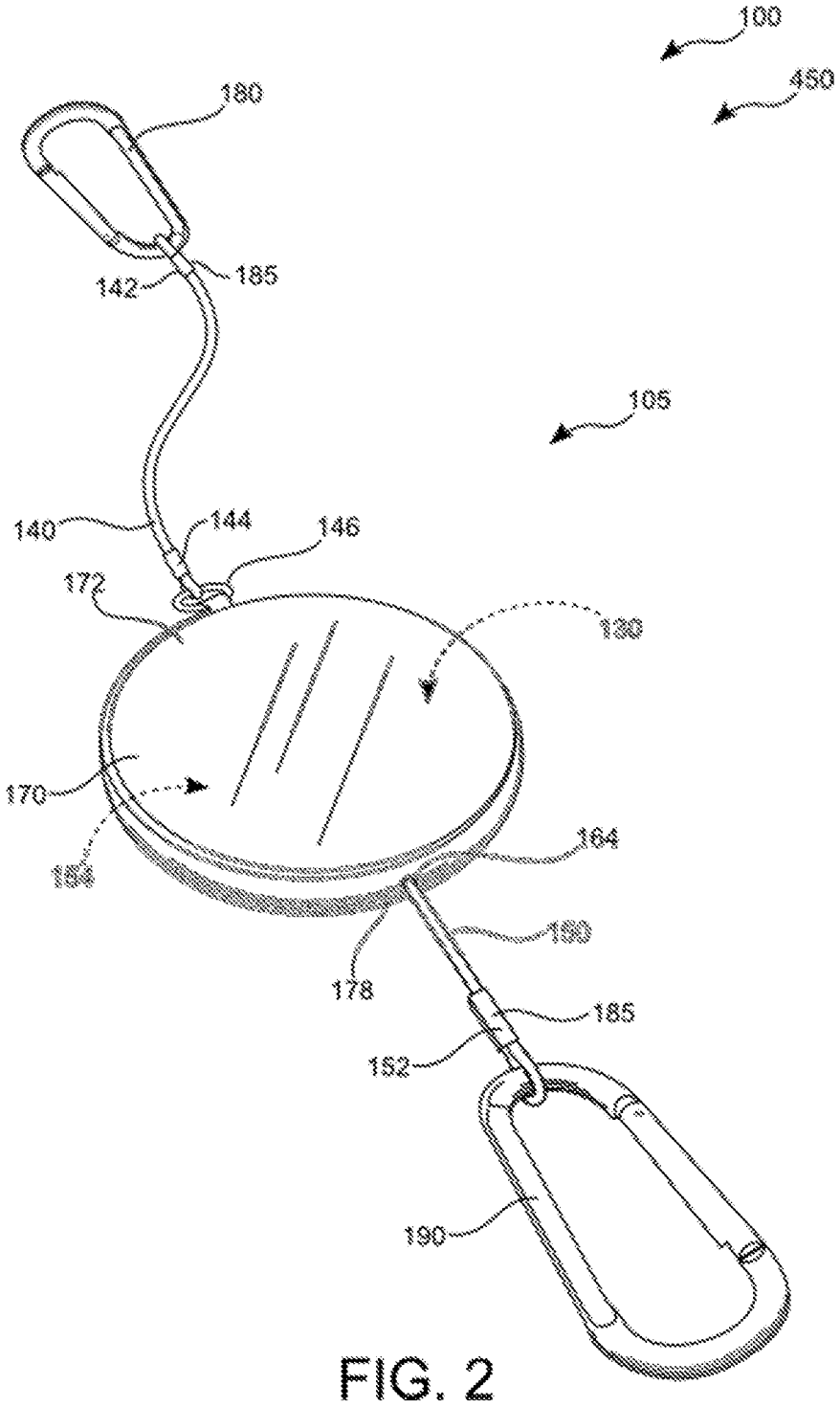
FIG. 2 is a perspective view illustrating the hard hat safety line system according to an embodiment of the present invention of FIG. 1.

Referring now to FIG. 2, a perspective view illustrating hard hat safety line system 100 according to an embodiment of the present invention of FIG. 1.

Hard hat safety line system 100 preferably comprises safety line assembly 105 having first biasing spring-clip 180, second biasing spring-clip 190, first cord 140 having first end 142 and second end 144, second cord 150 having proximate end 152 and distal end 154, housing 170 having spool 130 and spring 160, inner volume 162, an attachment ring 146, and cord orifice 164. The components of safety line assembly 105 are operatively structured and arranged to provide a retractable cord for attaching first biasing spring-clip 180 to user 199 and second biasing spring-clip 190 to user's 199 hard hat 110 to prevent hard hat 110 from unintentionally falling off of a head of user 199 and falling to a point of impact below user 199. First biasing spring-clip 180 may be a carabiner and second biasing spring-clip 190 may also be a carabiner, both constructed of aluminum such that they are lightweight. Second cord 150 preferably comprises a high tensile strength fiber and is about 24 inches long such that the length of second cord 150 is sufficient to be attached to various attachment points of varying distances on safety harness 120 while user 199 wears hard hat 110 without second cord 150 pulling on hard hat 110.

Figure 3:
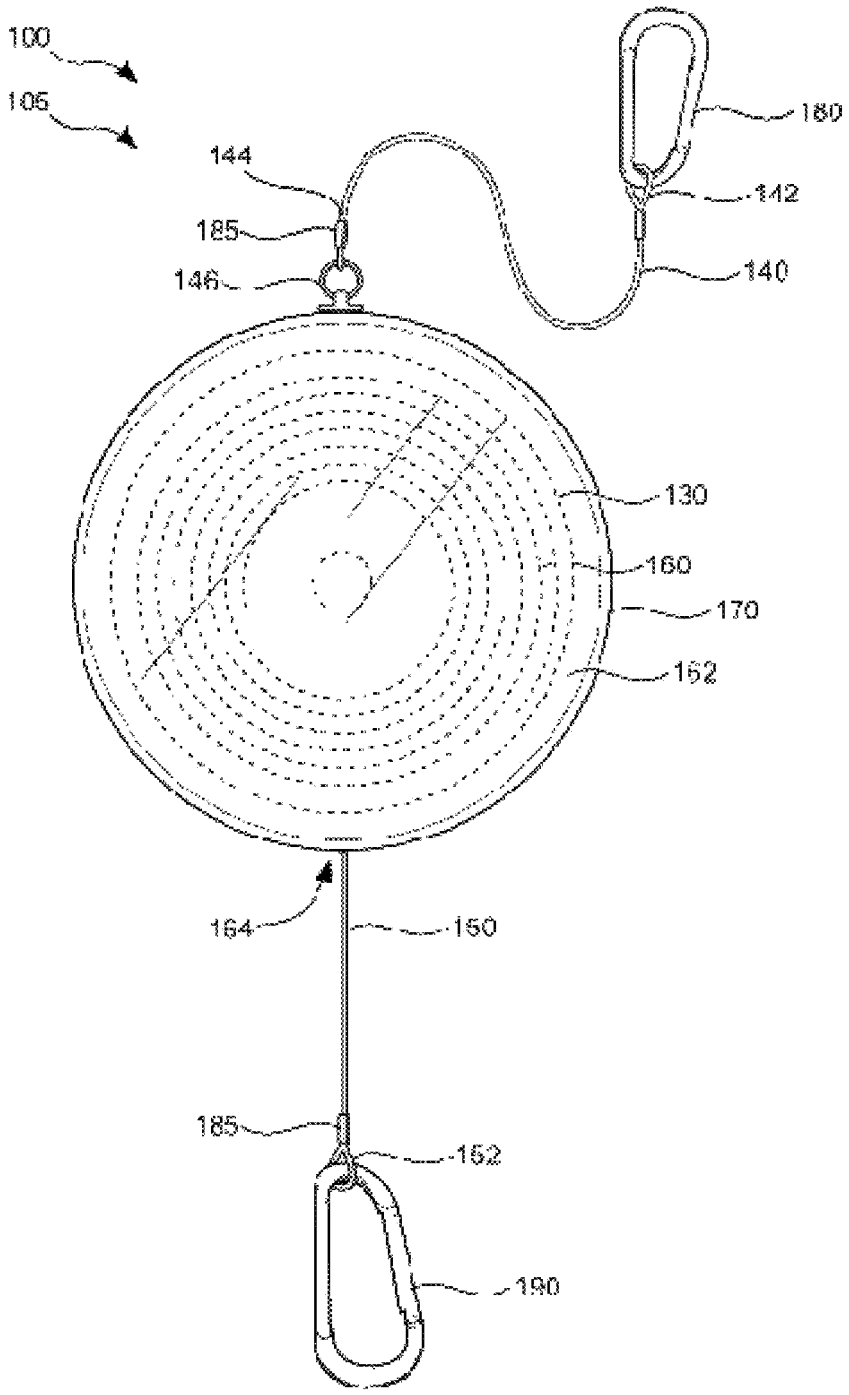
FIG. 3 is a front view illustrating the hard hat safety line system according to an embodiment of the present invention of FIG. 1.

Referring now to FIG. 3, a front view illustrating hard hat safety line system 100 according to an embodiment of the present invention of FIG. 1.

First cord 140 may be about 6 inches long, more or less, so that housing 170 can be located in close proximity to first biasing spring-clip 180. Second end 144 of first cord 140 is attached to attachment ring 146 and attachment ring 146 is removably attached to an attachment ring end 172 of housing 170. Spool 130 is rotationally attached to and located within inner volume 162 of housing 170. Housing 170 preferably comprises a circular disc shape and may be about 1½ inches in diameter and about ½ inch thick to reduce weight and bulk such that safety line assembly 105 is convenient to wear, however, housing 170 can be much smaller depending on diameter and strength of cord being used. Some cords are constructed of ultra high-strength materials and can be much smaller in diameter while providing greater tensile strength.

Housing 170 may further conveniently have a non-removable clip 176 mounted to back 174 of housing 170 such that housing 170 is able to be clipped onto a pocket or a safety harness strap, in addition to first biasing spring-clip 180 being attached, to prevent housing 170 from flopping around during movement. Housing 170 may comprise hardened plastic in some embodiments such that housing 170 is lightweight. It should be understood that specific materials used for construction of safety line assembly 105 may be different in various embodiments depending on such factors as cost, availability of materials, new advances in technology, or particular purpose.

Figure 4:
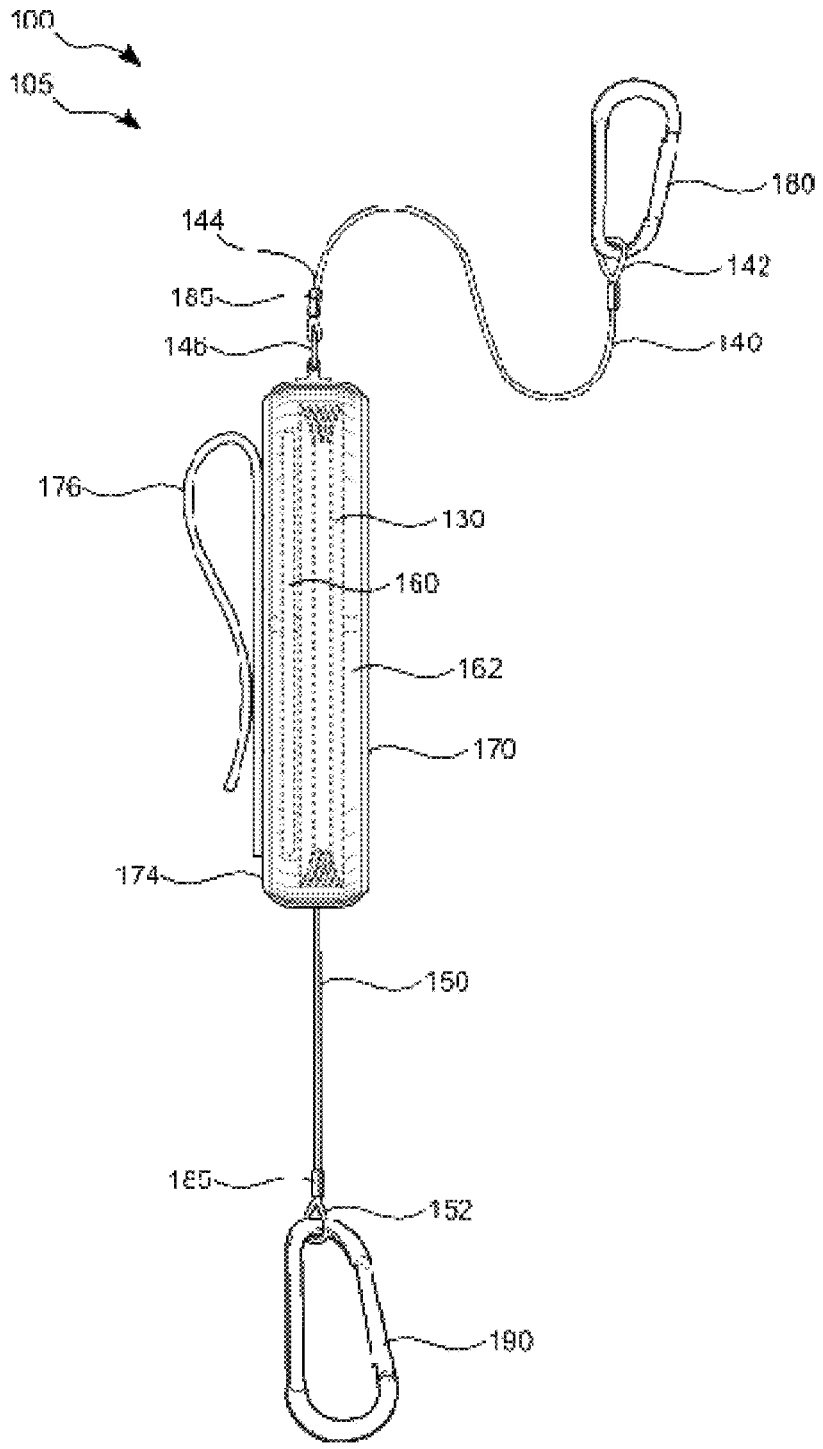
FIG. 4 is a side view illustrating the hard hat safety line system according to an embodiment of the present invention of FIG. 1.

Referring now to FIG. 4, a side view illustrating hard hat safety line system 100 according to an embodiment of the present invention of FIG. 1.

Spool 130 may comprise a flat spiral spring 160 that is structured and arranged to tensionally-wind spool 130 to retract second cord 150 onto spool 130 when flat spiral spring 160 is returning to an un-tensioned state, but not enough retraction force to pull on hard hat 110 as it is being worn. Distal end 154 of second cord 150 is attached to spool 130 such that second cord 150 is able to wrap circumferentially about spool 130 with proximate end 152 passing from inner volume 162 through cord orifice 164 on orifice end 178 of housing 170, to be removably attached to second biasing spring-clip 190 exteriorly of housing 170. proximate end 152 of second cord 150 may comprise a loop formed by proximate end 152 being doubled back and secured by a small light-weight crimp-lug 185.

Hard hat safety line system 100 may be sold as kit 450 comprising the following parts: at least one fully assembled safety line assembly 105 for attaching to hard hat 110 and to safety harness 120 to prevent unintentional dropping of hard hat 110; and at least one set of user instructions. The kit has instructions such that functional relationships are detailed in relation to the structure of the invention (such that the invention can be used, maintained, or the like in a preferred manner). Hard hat safety line system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
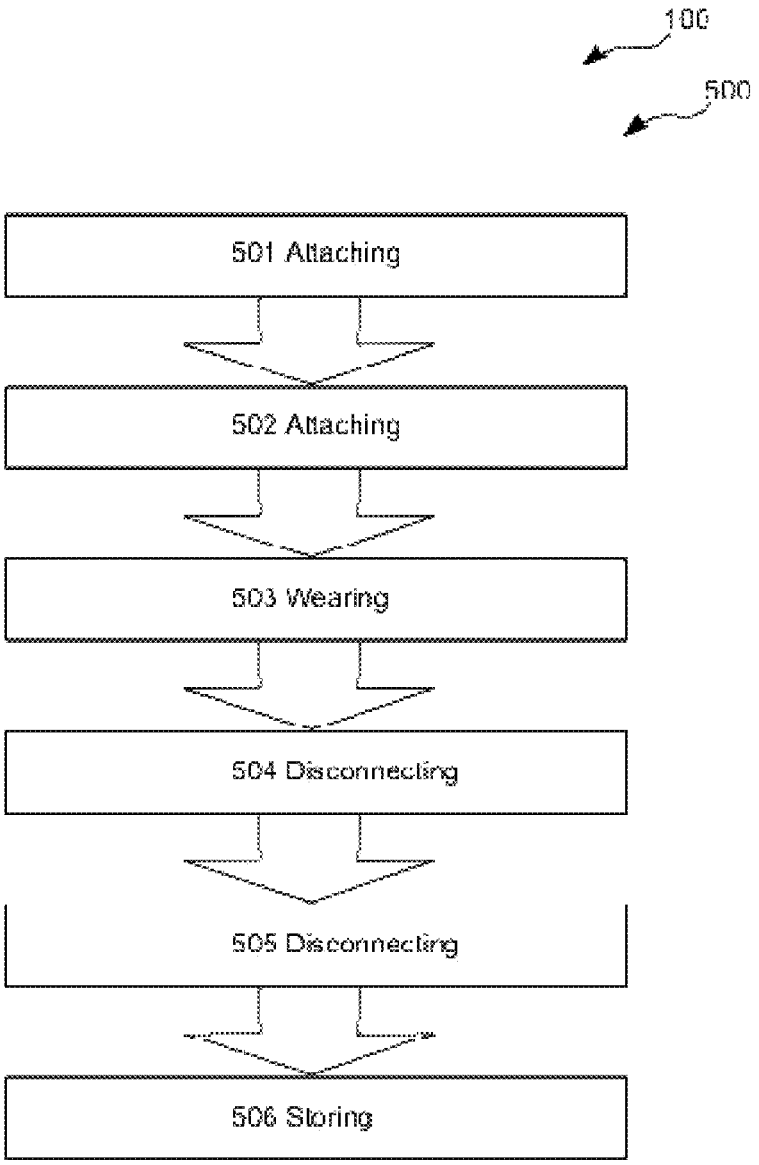
FIG. 5 is a flowchart illustrating a method of use for the hard hat safety line system according to an embodiment of the present invention of FIGS. 1-4.

Referring now to FIG. 5, showing method of use 500 for hard hat safety line system 100. A method of using (method of use 500) hard hat safety line system 100 may comprise the steps of step one 501 attaching first biasing spring-clip 180 of the safety line assembly 105 to a user 199 worn safety harness 120; step two 502 attaching second biasing spring-clip 190 of safety line assembly 105 to hard hat 110; step three 503 wearing hard hat 110 and safety harness 120 having safety line assembly 105 attached thereto; step four 504 disconnecting second biasing spring-clip 190 from hard hat 110; step five 505 disconnecting first biasing spring-clip 180 from safety harness 120; and step six 506 storing safety line assembly 105.

It should be noted that steps 501 and 505 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. § 112, ¶ 6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is:

1. A hard hat safety line system comprising:

a safety line assembly having;

a first biasing spring-clip;

a second biasing spring-clip;

a first cord having a first end and a second end;

a second cord having a proximate and a distal end;

a housing having;

a spool;

an inner volume;

an attachment ring; and a cord orifice;

wherein said safety line assembly comprising said first biasing spring-clip, said second biasing spring-clip, said first cord, said second cord, said spool, and said housing are operatively structured and arranged to provide a retractable cord adapted to releasably attach said first biasing spring-clip to a user and adapted to releasably attach said second biasing spring-clip to a hard hat to prevent said hard hat from unintentionally falling off of a head of a;

wherein said first biasing spring-clip is attached to said first end of said first cord;

wherein said second end of said first cord is attached to said attachment ring;

wherein said attachment ring is removably attached to an attachment ring end of said housing;

wherein said spool is rotationally attached to and located within said inner volume of said housing;

wherein said distal end of said second cord is attached to said spool such that said second cord is able to wrap circumferentially about said spool, said proximate end passing from said inner volume through said cord orifice to removably attached said proximate end of said second cord to said second biasing clip exteriorly of said housing.

2. The hard hat safety line system of claim 1 wherein said housing comprises a circular disc shape.

3. The hard hat safety line system of claim 1 wherein said second cord comprises a high tensile strength fiber.

4. The hard hat safety line system of claim 1 wherein said first cord is about six inches long such that said housing is located in close proximity to said first biasing spring-clip.

5. The hard hat safety line system of claim 1 wherein said second cord is about twenty four inches long.

6. The hard hat safety line system of claim 1 wherein said first biasing spring-clip comprises a carabiner.

7. The hard hat safety line system of claim 6 wherein said first biasing spring-clip comprises aluminum.

8. The hard hat safety line system of claim 1 wherein said second biasing spring-clip comprises a carabiner.

9. The hard hat safety line system of claim 1 wherein said second biasing spring-clip comprises aluminum.

10. The hard hat safety line system of claim 1 wherein said proximate end of said second cord comprises a loop, said loop formed by said proximate end being doubled back and secured by a crimp-lug.

11. The hard hat safety line system of claim 1 wherein said safety line assembly provides a tether between a hard hat and a safety harness without a cord entanglement hazard.

12. The hard hat safety line system of claim 2 wherein said housing is about one to one and a half inches in diameter and about one half inch thick such that said safety line assembly is convenient to wear.

13. The hard hat safety line system of claim 12 wherein said housing further comprises a clip mounted on said housing such that said housing is able to be directly connected to said hard hat.

14. The hard hat safety line system of claim 1 wherein said flat spiral spring comprises a low tension spring force sufficient for reeling said second cord onto said spool.

15. The hard hat safety line system of claim 2 wherein said housing comprises hardened plastic such that said housing is lightweight.

16. The hard hat safety line system of claim 1 wherein said housing is able to be removably attached to a safety harness via said first biasing spring-clip and said first cord, and said second biasing spring-clip of said second cord attached to said hard hat.

* * * * *